United States Patent [19]

Nishiguchi et al.

[11] Patent Number: 4,595,822

[45] Date of Patent: Jun. 17, 1986

[54] THERMAL HEAD AND PRODUCING PROCESS THEREOF

[75] Inventors: Yasuo Nishiguchi; Keijiro Minami, both of Kagoshima, Japan

[73] Assignee: Kyocera Corporation, Japan

[21] Appl. No.: 620,067

[22] Filed: Jun. 13, 1984

[30] Foreign Application Priority Data

Jun. 14, 1983 [JP] Japan ..... 58-106918

[51] Int. Cl.[4] ..... H05B 3/00; B41J 3/20

[52] U.S. Cl. ..... 219/216; 346/76 PH; 219/543; 338/308

[58] Field of Search ..... 219/216 PH, 543; 346/76 PH; 400/120; 338/307, 308, 309

[56] References Cited

U.S. PATENT DOCUMENTS

| | | | |
|---|---|---|---|
| Re. 30,313 | 6/1980 | Carcia | 338/308 |
| 2,683,673 | 7/1954 | Silversher | 338/308 |
| 2,920,005 | 1/1960 | Dearden | 338/308 |
| 2,961,352 | 11/1960 | Grattidge | 338/308 |
| 3,112,222 | 11/1963 | Alger | 338/308 |
| 3,218,194 | 11/1965 | Maissel | 338/308 |
| 3,301,707 | 1/1967 | Loeb | 338/308 |
| 3,973,106 | 8/1976 | Ura | 219/216 PH |
| 4,136,274 | 1/1979 | Shibata | 219/216 PH |
| 4,209,764 | 6/1980 | Merz | 338/308 |
| 4,232,213 | 11/1980 | Taguchi | 338/309 |
| 4,296,309 | 10/1981 | Shinmi | 219/216 |

*Primary Examiner*—Clarence L. Albritton
*Assistant Examiner*—Teresa J. Walberg
*Attorney, Agent, or Firm*—Spensley Horn Jubas & Lubitz

[57] ABSTRACT

A thermal head composed of an electrically insulative substrate, a resistive film made of $TiO_x$ ($0<x<2$) formed on the substrate, and an electrode made of a metal such as Au, Al, and Cu etc. The resistive film is produced by an electron beam vapor deposition method employing an apparatus having a vacuum chamber wherein an evaporation source composed of Ti is irradiated with an electron beam to evaporate Ti so as to deposit a resultant $TiO_x$ on the substrate.

4 Claims, 4 Drawing Figures

THERMAL HEAD AND PRODUCING PROCESS THEREOF

BACKGROUND OF THE INVENTION

1. Field of the Invention

This invention relates to an improvement of thermal head used in thermal recording, and more particularly, to a composition of an electrically energized resistive film.

2. Description of the Prior Art

Heretofore, such a thermal head in the prior art, for instance as shown in FIG. 1, comprises a substrate 1 made of electrically insulative material such as alumina, a resistive film 2 made of tantalum nitride ($Ta_2N$), and an electrode 3 made of gold (Au), aluminum (Al), copper (Cu) or other metal, which are sequentially laminated, wherein a certain voltage is applied to the resistive film 2 through the electrode 3 to generate Joule heat in the film 2 to function as thermal head. A protective film 21 is formed on the electrode 3.

In this conventional thermal head, since the affinity between $Ta_2N$, the material of resistive film 2, and Au, Al or Cu, the material of electrode 3, is poor, the junction strength of the resistive film 2 and the electrode 3 is extremely weak, and the electrode 3 may be easily separated from the resistive film 2 when an external force is applied in operation, so that predetermined voltage may not be applied to the resistive film 2. Accordingly, in this thermal head, the resisitive film 2 cannot be heated to a desired temperature by Joule heat, and the function as thermal head may not be achieved or printing defect may be caused.

In order to prevent such electrode separation in the thermal head in the prior art a thermal head having an adhesion layer 4 possessing an intensified affinity for both the resistive film 2 and the electrode 3 interposed between them was proposed as shown in FIG. 2. However, in this thermal head, although the separation of electrode 3 may be effectively prevented by the interposition of the adhesion layer 4, this layer must be separately formed between the film 2 and electrode 3, which makes the manufacturing process of thermal head more complicated, and impairs the productivity and yield, thereby increasing the cost of thermal head as a product.

SUMMARY OF THE INVENTION

Therefore, it is one object of this invention to provide an improved thermal head.

It is another object of this invention to provide a thermal head having a great junction strength between the resistive film and electrode and capable of obtaining a stable printing for a long period of time.

It is yet another object of this invention to provide an inexpensive thermal head.

From our various experiments it has been found that the resistive film composed of $TiO_x(0<\times<2)$ generates a Joule heat of a desired temperature, and TiOx $(0<\times<2)$ has an intensified affinity for the metal of the electrode such as Au, Al, or Cu.

Hence, the thermal head according to an aspect of the invention comprises a substrate composed of an electrically insulative material, a resistive film comprising $TiO_x$ $(0<\times<2)$ and formed on the substrate, and an electrode on the resistive film.

In a preferred embodiment of the invention, the electrode is composed of a metal selected from the group consisting of Au, Al, and Cu.

In another preferred embodiment of the present invention, a protective film is formed on the electrode and on the exposed area of the resistive film.

In a further preferred embodiment of the present invention, the resistive film has a specific electric resistivity within 100 to 850 $\mu\Omega$.cm.

A process for producing a thermal head according to another aspect of the invention comprises the steps of preparing an electrically insulative substrate, forming a resistive film comprising $TiO_x(0<\times<2)$ on the electrically insulative substrate, and forming an electrode on the resistive film.

In a preferred embodiment of the invention, the step of forming the resistive film on the electrically insulative substrate is accomplished by an electron beam vapor deposition method.

In another preferred embodiment of the invention, the electron beam vapor deposition method comprises (a) preparing an apparatus comprising a vacuum chamber for containing a cathode, an anode, an evaporation source composed of Ti and a substrate holder having a substrate disposed thereon, (b) irradiating the evaporation source composed of Ti with an electron beam to evaporate Ti in the vacuum chamber, and (c) causing evaporated Ti to be bonded with the oxygen remaining in the vacuum container to thereby deposit $TiO_x$ on the substrate.

In a further preferred embodiment of the invention, the vacuum chamber has the vacuum degree within $2\times10^{-5}$ to $5\times10^{-6}$ torr.

In a still further preferred embodiment of the present invention, the electron beam is emitted by applying a voltage of about 20 kV between the cathode and the anode in the vacuum container.

In a yet further preferred embodiment of the invention, the $TiO_x$ is deposited on the substrate at the rate of about 20 to 100 Å/min.

In still another preferred embodiment of the invention, the step of forming the electrode on the resistive film is accomplished by preparing a metal selected from the group consisting of Au, Al, and Cu as a material of the electrode and utilizing a vapor deposition method and etching process.

Thus, in the thermal head of this invention, the resistive film generates a Joule heat of a specified temperature, and $TiO_x$ (where x is smaller than 2.0) has a intensified affinity for the metal of the electrode, the resistive film and the electrode can be thereby joined together firmly. Accordingly, if an external force is applied during operation, the electrode will never be separated from the resistive film, and a defined voltage may be always applied to the resistive film, and Joule heat may be generated to reach a specified temperature, so that a stable printing may be realized for a long period of time.

Besides, in the thermal head of this invention, since the resistive film and electrode may be joined together firmly without interposition of adhesive layer, the step of forming adhesive layer is not necessary, and the manufacturing process of thermal head is extremely simple. Hence, the productivity is extremely good, and the manufacturing cost of thermal head may be notably reduced.

The other objects and features of this invention will be more clearly understood by the following description set forth by reference to the drawings.

DETAILED DESCRIPTION OF THE PREFERRED EMBODIMENT

Figure 1:
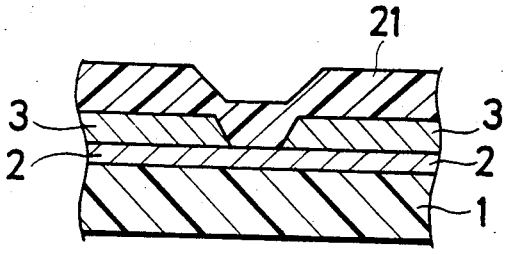
Fig. 1 Prior Art
FIG. 1 is a sectional view showing a thermal head in the prior art.
Figure 2:
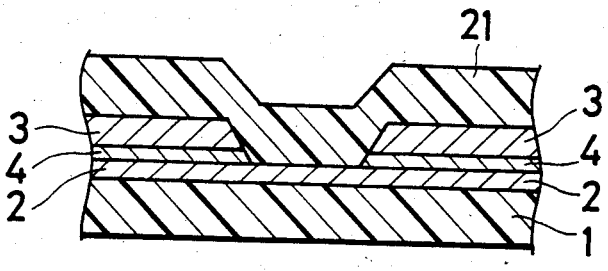
Fig. 2 Prior Art
FIG. 2 is a sectional view showing another thermal head in the prior art.
Figure 3:
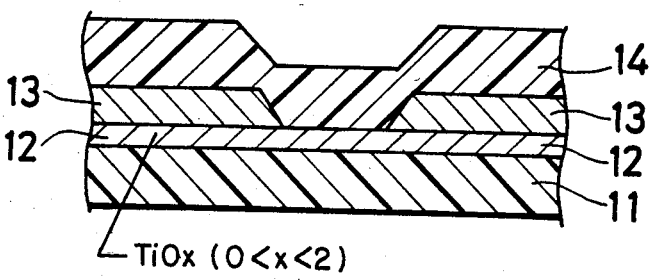
FIG. 3 is a sectional view showing a thermal head according to one of the embodiments of the present invention.

This invention is described in details below by referring to the embodiment illustrated in the appended drawings. FIG. 3 shows one embodiment of the thermal head of this invention, in which numeral 11 indicates substrate made of an electrically insulative material such as alumina. A resistive film 12 is formed on this substrate 11, and an electrode 13 is formed on this resistive film 12, and a protective film 14 is formed on the electrode 13 so as to prevent abrasion due to contact of thermal sensitive paper.

The resistive film 12 is made of $TiO_x$, where x is smaller than 2.0, so that the electric resistively may be controlled within 100 to 850 microhm-centimeter. Since the resistive film 12 possesses a specified electric resistivity, Joule heat is generated when a specified voltage is applied, thereby causing the resistive film 12 to reach a temperature necessary for printing, such as somewhere between 100° and 150° C.

The electric resistivity of this resistive film 12 may be freely adjusted by varying the value of x in $TiO_x$, so that the temperature of the resistive film 12 may be adjusted to be raised to a desired temperature, thereby allowing enlargement of the application range of the thermal head. The electrode 13 on this resistive film 12 is composed of at least one of Au, Al and Cu, and is responsible for applying a voltage for creating Joule heat in the resistive film 12. The resistive film 12 is formed on the substrate 11 by an electron beam vapor deposition method which is described later, and the electrode 13 is formed on the resistive film 12 by employing a conventionally known deposition method and etching process. In this case, $TiO_x$, the material of the resistive film 12, has an extremely excellent affinity for Au, Al, or Cu, the material of the electrode, so that the resistive film 12 and electrode 13 are joined together firmly. Therefore, if an external force is applied, the electrode 13 will not be separated from the resistive film 12.

Figure 4:
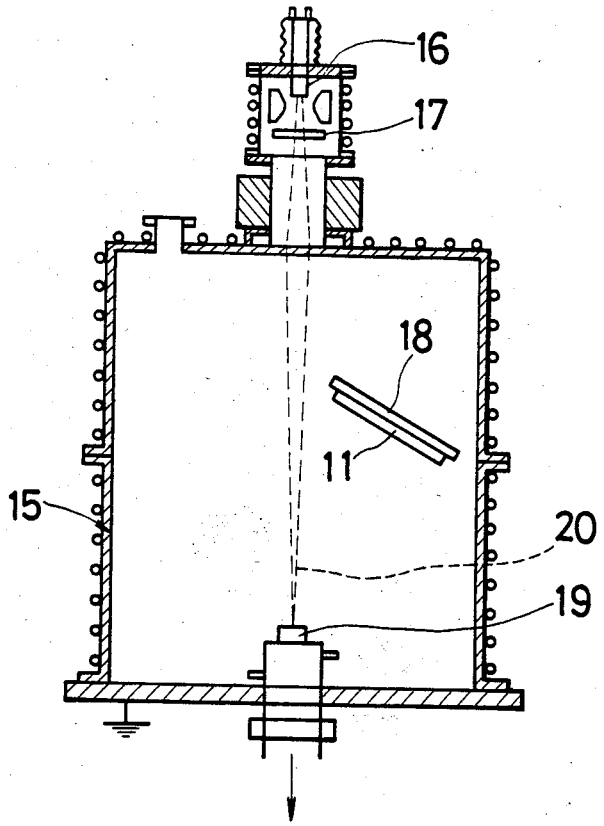
FIG. 4 is a structural drawing of an electron beam vapor deposition apparatus for forming a resistive film on the substrate in the thermal head of this invention.

Referring now to the method of forming a resistive film in the thermal head of this invention, the resistive film 12 in this thermal head is formed by electron beam vapor deposition method, more practically, by use of an electron beam vapor deposition apparatus as shown in FIG. 4. This electron beam vapor deposition apparatus comprises a cathode 16, an anode 17, a substrate holder 18 and a evaporation source 19, which are all contained in a vacuum chamber 15.

To form a resistive film 12 by use of this electron beam vapor deposition apparatus, first a substrate 11 is placed on a substrate holder 18, and titanium (Ti) is disposed on the evaporation source 19. Controlling the degree of vacuum in the vacuum chamber 15 within $2\times10^{-5}$ to $5\times10^{-6}$ torr, a high voltage (about 20 kV) is applied between the cathode 16 and anode 17 to emit an electron beam 20. The evaporation source (Ti) is irradiated with this electron beam 20 to heat and melt the source (Ti) in order to cause it to evaporate at a uniform density within the chamber 15. Then, the evaporated Ti is bonded with the oxygen remaining in the chamber 15 so that $TiO_x$ is deposited on the substrate 11. As a result, the resistive film 12 is formed on the substrate 11.

The value of x of $TiO_x$ to compose the resistive film 12 is controlled by the concentration of residual oxygen in the electron beam vapor deposition apparatus, temperature, and rate of vapor deposition. Meanwhile, the rate of vapor deposition of resistive film 12 is about 20 to 100 Å/min.

Using this electron beam vapor deposition apparatus, since Ti, the evaporation source, is evaporated at a uniform density in the entire vacuum chamber, the resistive film may be formed on the entire surface of the substrate at a uniform density. Therefore, when operated as thermal head, the heat generation of the resistive film is uniform over the entire surface, so that an extremely favorable printing may be realized.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all charges which come within the meaning and range of equivalency of the claims are therefore intended to be embraced therein.

What is claimed is:

1. A thermal head comprising:

a substrate comprising an electrically insulative material;

a resistive film substantially composed of $TiO_x$ $(0<\times<2)$; and an electrode formed on one surface of said resistive film.

2. A thermal head as claimed in claim 1, wherein the electrode comprises a metal selected from the group consisting of Au, Al, and Cu.

3. A thermal head as claimed in claim 1 wherein said resistive film includes a portion which is not covered by said electrode, and further comprising a protective film formed on both the electrode and the area of said one surface of the resistive film which is not covered by said electrode.

4. A thermal head as claimed in claim 1, wherein the resistive film has an electric resistivity within 100 to 850 $\mu\Omega$.cm.

* * * * *